US006668925B2

(12) United States Patent
Shaw et al.

(10) Patent No.: US 6,668,925 B2
(45) Date of Patent: Dec. 30, 2003

(54) ESP PUMP FOR GASSY WELLS

(75) Inventors: Christopher K. Shaw, Claremore, OK (US); David A. Voss, Tulsa, OK (US); Jeffrey W. Knight, Collinsville, OK (US); Michael J. Fox, Claremore, OK (US); Dewey Michael Loudermilk, Kingwood, TX (US); Kenneth T. Bebak, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 6 days.

(21) Appl. No.: 10/061,100

(22) Filed: Feb. 1, 2002

(65) Prior Publication Data

US 2003/0145989 A1 Aug. 7, 2003

(51) Int. Cl.[7] ..... E21B 43/38

(52) U.S. Cl. ..... 166/265; 166/105.5; 166/106; 166/370

(58) Field of Search ..... 166/66.4, 68, 105.3, 166/105.4, 105.5, 106, 265, 370

(56) References Cited

U.S. PATENT DOCUMENTS

| | | | | |
|---|---|---|---|---|
| 3,291,057 A | | 12/1966 | Carle | |
| 3,672,795 A | | 6/1972 | Arutunoff et al. | |
| 4,003,428 A | | 1/1977 | Zehren | |
| 4,171,934 A | | 10/1979 | Zehren | |
| 4,331,203 A | | 5/1982 | Kiefer | |
| 4,352,394 A | | 10/1982 | Zehren | |
| 4,366,861 A | | 1/1983 | Milam | |
| 4,391,330 A | | 7/1983 | Kiefer | |
| 4,425,965 A | | 1/1984 | Bayh, III et al. | |
| 4,440,221 A | | 4/1984 | Taylor et al. | |
| 4,529,035 A | | 7/1985 | Bayh, III | |
| 4,621,689 A | | 11/1986 | Brookbank, III | |
| 4,625,798 A | | 12/1986 | Bayh, III | |
| 4,913,630 A | | 4/1990 | Cotherman et al. | |
| 4,981,175 A | | 1/1991 | Powers | |
| 5,154,588 A | * | 10/1992 | Freet et al. | 166/105.5 |
| 5,271,725 A | * | 12/1993 | Freet et al. | 166/105.5 |
| 5,482,117 A | | 1/1996 | Kolpak et al. | |
| 5,529,127 A | | 6/1996 | Burleson et al. | |
| 5,662,167 A | * | 9/1997 | Patterson et al. | 166/265 |
| 6,135,210 A | | 10/2000 | Rivas | |
| 6,216,788 B1 | | 4/2001 | Wilson | |
| 6,406,277 B1 | | 6/2002 | Shafer et al. | |

OTHER PUBLICATIONS

Inventor: Neuroth et al, Method and Apparatus to Remove Coiled Tubing Deployed Equipment in High Sand Applications.

Tubular Junction for Tubing Pump, This application claims the benefits of provisional application S.N. 60/107,919 filed Nov. 10, 1998.

Thru–Tubing Retrievable Packer Product No. 330–01; product information; Baker Hughes; Mar. 1996.

* cited by examiner

*Primary Examiner*—David Bagnell
*Assistant Examiner*—Brian Halford
(74) *Attorney, Agent, or Firm*—Bracewell & Patterson LLP

(57) ABSTRACT

"Well equipment transporting well fluid from a gassy well. A conduit is hung and sealed inside a string of casing, forcing the gas and well fluid to flow into the conduit. A gas separator and a series of flow controls and valves are mounted into and run with the conduit. A pump assembly is hung and sealed into the conduit for pumping well fluid to the surface. The pump assembly is lowered and retrieved from the conduit on tubing. The pump may be located below the motor, or above the motor."

29 Claims, 4 Drawing Sheets

ESP PUMP FOR GASSY WELLS

BACKGROUND OF THE INVENTION

1. Field of the Invention

The invention relates generally to a means of improving the production capacity of a gaseous oil well by separating the gas from the crude oil before pumping the oil up the well.

2. Description of the Related Art

When an oil well is initially completed, the downhole pressure may be sufficient to force the well fluid up the well tubing string to the surface. The downhole pressure in some wells decreases, and some form of artificial lift is required to get the well fluid to the surface. One form of artificial lift is suspending an electric submersible pump (ESP) downhole in the tubing string. The ESP will provide the extra lift necessary for the well fluid to reach the surface. In gassy wells, or wells which produce gas along with oil, there is a tendency for the gas to enter the pump along with the well fluid. Gas in the pump decreases the volume of oil transported to the surface, which decreases the overall efficiency of the pump and reduces oil production.

In order to prevent the gas from interfering with the pumping of the oil, various downhole separators have been developed to remove gas from the well fluid prior to the introduction of the fluid into the pump. A typical gas separator is attached to the lower end of the pump assembly, which in turn is suspended on production tubing. Normal gas separators separate most of the gas and discharge the separated gas into the annulus outside the tubing string where the gas flows up the well to the surface. The separator discharges the liquid into the tubing to be pumped to the surface.

A first disadvantage of these separation and pumping systems is that intervention is costly and difficult because the pump assembly is attached to lower end of the tubing string. With the pump assembly attached to the lower end of the tubing string, the well must be "killed," or the flow of gas and fluid through the perforations is stopped, in order to provide a safe working environment while the tubing string is out of the well. If the well is killed without a means of preventing downward flow, well fluid will flow back into the well where it could be too difficult to retrieve. A second disadvantage of these separation and pumping systems is that all the gas is not always separated from the well fluid, thus a significant portion of the gas may still flow into the pump.

Proposals have been made to suspend the pump assembly and separator on coiled tubing lowered into a liner or casing. However, improvements, particularly for gas separation, are desirable.

SUMMARY OF THE INVENTION

The present invention contemplates a means of pumping gas from gassy wells in which the gas is separated before entering the pump by a gas separator located below the pump within a section of a liner or conduit. The pump assembly is lowered into the liner and suspended above the gas separator. There is a set of valves and flow control devices located in the conduit below the pump that allows the pump to be installed and removed while the well is live.

The conduit lands and sealingly engages a packer set in the casing. The conduit has an opening in its lower portion for receiving the gas and well fluid flowing from the perforations in the well. A gas separator is located inside of the conduit for separating gas from the well fluid flowing from the well. The gas that is separated from the well fluid is discharged to an area surrounding the conduit where the gas will flow to the surface. The remaining well fluid is discharged up the conduit.

The pump assembly is made up of a pump, which has an inlet and an outlet, and a motor to drive the pump. The pump assembly lands in the conduit so that the pump and motor are above and not engaged with the gas separator. A pump seal located between the pump and the conduit seals the pump to the conduit when the pump assembly lands in the conduit. The gas separator below the pump separates most of the gas from the well fluid, therefore the pump is more efficient, and can produce more crude oil. The pump outlet is above the pump seal, accordingly the well fluid is discharged into the conduit, above the pump seal, where the fluid flows to the surface.

In the preferred embodiment, there will also be a flow control valve located in the conduit so that the well fluid cannot flow back into well. A circulation valve located above the flow control valve allows circulation from the conduit into the annulus surrounding the conduit. Finally, in the preferred embodiment, a pressure actuated downhole safety valve is located in the conduit to prevent well fluid from flowing up the conduit when it is closed.

In one embodiment of the well, the pump is suspended above the motor, and the pump seal creates a chamber inside of the conduit below the pump seal and above the gas separator. In this embodiment, some of the gas remaining with the well fluid after passing through the gas separator will collect in the chamber. A shroud located below the pump inlet makes it difficult for the remaining gas to enter the pump, so the gas flows past the inlet and collects at the top of the chamber. The remaining gas that collects in the chamber is vented out of the chamber by a vent. In one embodiment, the vent is through the pump seal and opens into the area inside the conduit above the seal. The gas then flows up the conduit to the surface. In another embodiment, the pump assembly is suspended by tubing, and the vent fluidly connects the chamber with the inside of the tubing. In this embodiment the gas flows up the tubing to the surface. In another embodiment, the vent is located in the conduit and discharges the remaining gas to the annulus, where the gas will flow to the surface.

In the final embodiment, the pump is located below the motor, the motor being suspended by a string of coil tubing. In this embodiment, the pump seals engage the conduit when the pump lands in an area of the conduit having a reduced diameter. The gas is separated from the well fluid by the gas separator and discharged into the annulus. The well fluid and some remaining gas flow into the pump inlet, where the fluid and remaining gas are pumped and discharged above the seal to flow to the surface inside the conduit. In this embodiment, there may also be a sand skirt for collecting sand that settles from the fluid flowing to the surface. With any of these embodiments, the pump assembly may be removed for intervention without having to kill the well by closing the safety valve.

DETAILED DESCRIPTION OF THE PREFERRED EMBODIMENTS

Figure 1:
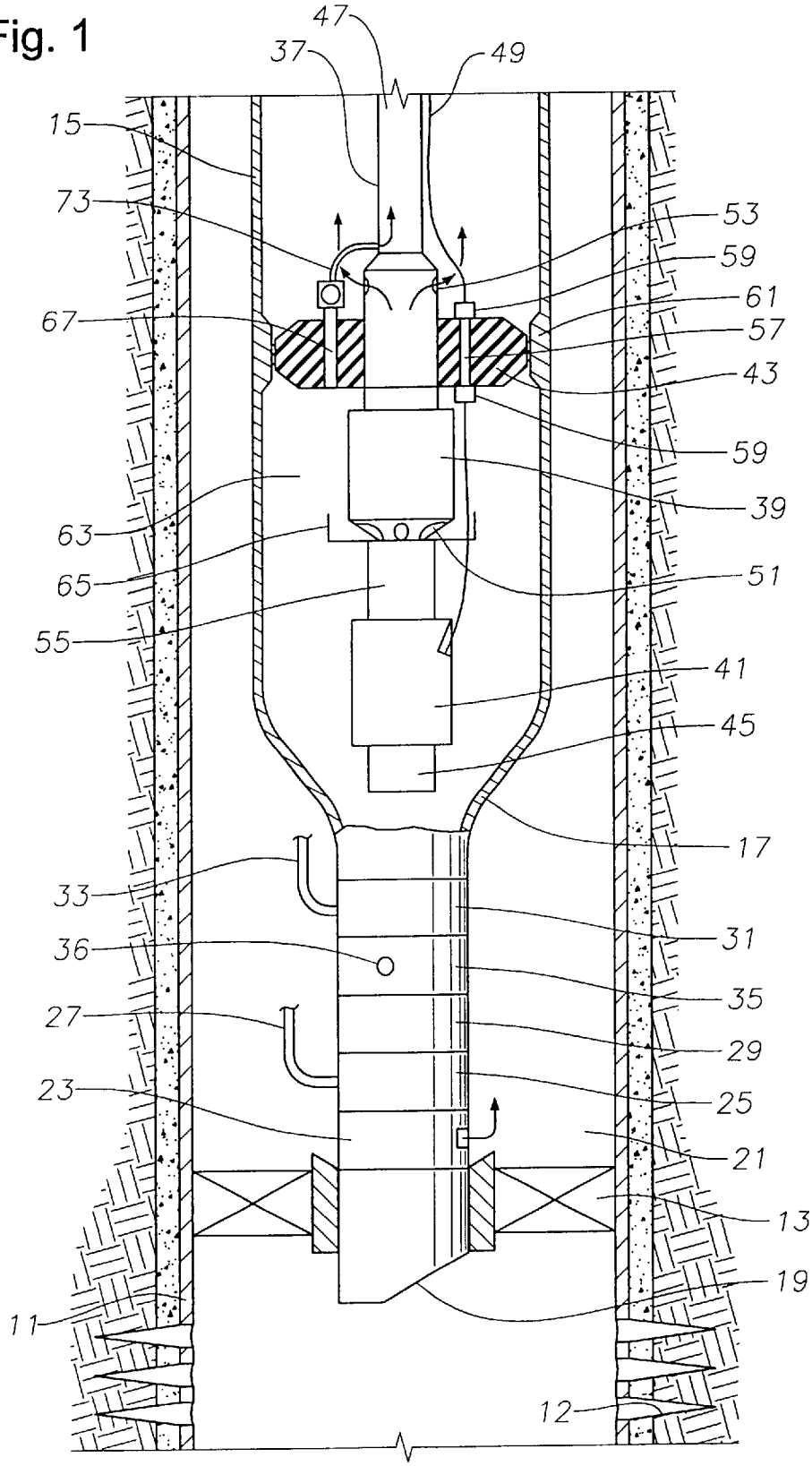
FIG. 1 comprises a schematic cross-sectional view of a lower end of a well constructed in accordance with this invention.

FIG. 1 shows the first embodiment of the means for pumping liquids from a gassy well. Referring to FIG. 1, a string of casing 11 has been hung and landed into the well. Perforations 12 in casing 11 allow well fluid to enter casing 11. A packer 13 extends towards the center of the well from the inner surface of casing 11 along the lower section of casing 11 above perforations 12. A conduit 15, or liner, is hung in the well and landed in packer 13 so that the outer surface of conduit 15 is sealingly connected to packer 13. Alternatively, packer 13 could be run into the well along with conduit 11, then set. Conduit 15 is made up of sections of casing secured together. In the preferred embodiment, conduit 15 has a reduced diameter section 17 towards the lower end of conduit 15. Reduced diameter section 17 has a diameter that is comparable to conventional production tubing. Reduced diameter section 17 is the portion of conduit 15 that lands and seals with packer 13. The central opening in packer 13 has a flapper valve (not shown) that opens when the lower end of conduit 15 stabs into packer 13. A conduit opening 19 is located at the lower end of conduit 15 for receiving well fluid from perforations 12. Conduit opening 19 is the only means for the well fluid to flow to the surface because packer 13 is sealingly connected between casing 11 and conduit 15. An annulus 21 is located in the area surrounding the outer surface of conduit 15 and above packer 13.

A gas separator 23 is located in the string of conduit 15 above conduit opening 19. In the preferred embodiment, gas separator 23 is a static gas separator which uses stationary vanes (not shown) having a geometry for creating a swirling motion as the well fluid passes through separator 23. A portion of the gas in the well fluid is separated due to centrifugal force and discharged into an annulus 21 located in the area surrounding conduit 15 as indicated by the arrow. The gas discharged into annulus 21 flows up the well to be collected at the surface. In the preferred embodiment, gas separator 23 is located in reduced conduit diameter section 17. The well fluid flowing upward from gas separator 23 will still have some gas in most cases.

A chemical injection chamber 25 optionally may be located in conduit 15. Chemical injection chamber 25 is a passageway in which the well fluid is treated with chemicals. The types of chemicals injected into the well fluid in chemical injection chamber 25 will vary based upon different production conditions. For example, an operator may inject chemicals to reduce scaling, paraffin deposits, or to help lower the viscosity of the crude oil in the well fluid. A chemical supply line 27 which is in fluid communication with a chemical supply at the surface (not shown) provides the chemicals being injected into the well fluid in chemical injection chamber 25. In the preferred embodiment, chemical injection chamber 25 is located above gas separator 23 and receives the well fluid after gas separator 23 discharges the gas into annulus 21.

A flow control valve 29 is located in conduit 15 to prevent well fluid from flowing back down through conduit opening 19. Flow control valve 29 is a check valve that allows upward flow of well fluid through conduit 15, but prevents downward flow of well fluid so that well fluid does not go back through conduit opening 19, thereby preventing fluid loss into perforations 12. In the preferred embodiment, flow control valve 29 is located in reduced diameter section 17, above gas separator 23.

A downhole safety valve 31, which is actuated by hydraulic pressure supplied by hydraulic fluid line 33, is located in conduit 15 above flow control valve 29. Downhole safety valve 31 is closed when there is no pressure applied to valve 31 from the hydraulic fluid supplied by hydraulic fluid line 33. With downhole safety valve 31 closed well fluid cannot continue to flow up the well. Downhole safety valve 31 is opened by supplying hydraulic fluid through fluid line 33 to create the necessary hydraulic pressure. Well fluid continues flow up conduit 15 when downhole safety valve 31 is open.

A circulation control valve 35 is an operable valve located in conduit 15 below downhole safety valve 31 to allow circulation through conduit 15 if desired. In the preferred embodiment, circulation control valve 35 has a normally closed port 36 leading to annulus 21 and is located in reduced conduit inner diameter section 17. Circulation valve 35 is pressure activated. In the preferred embodiment, circulation valve 35 is a tubing pressure activated communication sleeve (TPACS). Circulation valve 35 allows the well fluid to normally flow up conduit 15 towards downhole safety valve 31 while circulation valve 35 is in its open position. Circulation valve 35 redirects fluid flowing down conduit 15 through its port 36 to flow into annulus 21 while circulation valve 35 is in its circulation position. To place circulation valve 35 in its circulation position, the operator applies fluid pressure of a selected amount to the interior of conduit 15. The fluid being discharged through port 36 flows back to the surface through annulus 21. Flow control valve 29 prevents the fluid being pumped down conduit 15 from flowing downward into perforations 12. Circulation valve 35 returns to its open position when the pressure inside conduit 15 is decreased by the operator.

A pump assembly 37 is hung and landed into conduit 15. Pump assembly 37 may have an outer diameter greater than an inner diameter of conduit reduced diameter section 17. Pump assembly 37 consists of a pump 39, a motor 41, a pump seal 43, a seal section 55, and optionally a flow sensor 45. In the embodiment shown in FIG. 1, pump 39 is lowered down conduit 15 on the lower end of a string of tubing 47. Tubing 47 in this embodiment comprises sections of tubing screwed together, with a power supply 49 running along the outside of tubing 47. Tubing 47 could also be coiled tubing. Tubing 47 supports pump assembly 37, and is also a passageway for transporting gas that is not separated by gas separator 23 up the well. Pump 39 has at least one pump inlet 51 located on the lower portion of the pump 39, and at least one pump outlet 53 located on the upper portion of pump 39. In the preferred embodiment, pump 39 is an electrical submersible pump (ESP), which can be a centrifugal type of ESP.

In the first embodiment, motor 41 is located below pump 39. Motor 41 drives pump 39 through a motor drive shaft (not shown) connecting to the lower end of pump 39, which is enclosed by seal section 55. Power cable 49 provides motor with electricity. Power cable 49 runs down the well alongside tubing 47, passes through a pump seal passageway 57 having sealed ends 59 where power cable 49 enters and exits passageway 57, and connects with motor 41 below pump 39. Flow sensor 45 is attached to the lower end of motor 41 for measuring the volume of fluid that is flowing into pump 39.

Pump seal 43 is sealingly connected to the outer surface of pump 39 between pump inlet 51 and outlet 53. Pump seal 43 lands and sealingly connects with a seal bore 61 located and protruding from on the inner surface of conduit 15. Pump 39 discharges into conduit 15 above seal 43. A chamber 63 is formed when pump seal 43 lands and seals with seal bore 61, which is defined by the bottom surface of pump seal 43 and the inner surface of conduit 15. Pump seal 43 is an annular elastomer.

A shroud 65 may be connected to the lower end of pump 39 to help prevent gas that remains in the well fluid after passing through gas separator 23 from entering pump 39. Shroud 65 extends radially away from inlet 51 of pump 39 towards conduit 15, and up so that the ends of shroud 65 are above pump inlet 51. Shroud 65 retards gas remaining in the well fluid after separation from entering pump 39 by forcing the well fluid and gas to go up in chamber 63 above pump inlet 51. The remaining gas, being the lighter substance, gathers in chamber 63 above pump inlet 51 while the well fluids flow back down to pump inlet 51. In the first embodiment, a vent 67 with a lower end on the bottom surface of pump seal 43 and an upper end on the top surface of pump seal 43 vents gas collected in chamber 63. A check valve in vent 67 prevents downward flow of well fluid. In the first embodiment, a collection tube 73, which gathers and leads gas exiting chamber 63 via vent 67, extends to tubing 47 to vent the gas in tubing 47.

In the operation of the first embodiment, gas separator 23, chemical injection chamber 25, flow control valve 29, circulation valve 35 and downhole safety valve 31 are mounted to conduit 15 at the surface. Conduit 15 is then lowered into the well and landed in packer 13, which seals conduit 15 to casing 11. Downhole safety valve 31 is placed in a closed position. Then pump 39 and its associated components are lowered into conduit 15 on tubing 47. Pump seal 43 lands and seals to seal bore 61.

Downhole valve 31 is opened to allow well fluid to flow into chamber 63 and power is supplied to motor 41. The gas and well fluid flow up conduit 15 to gas separator 23, where the gas from the well is separated and discharged into annulus 21. The remaining well fluid flows from gas separator 23, up conduit 15, into chemical injection chamber 25 where the well fluid may be chemically treated with chemicals that are injected into the well fluid through chemical supply line 27. The chemically treated well fluid flows up conduit 15 through flow control valve 29, which allows the upward flow of well fluid and prevents the well fluid from flowing downward. The well fluid flows up conduit 15 through circulation valve 35, through open downhole safety valve 31, and into chamber 63.

The well fluid enters chamber 63 from down hole safety valve 31 and flows past motor 41. Shroud 65 prevents the well fluid from entering pump inlet 51 until the well fluid flows past and back down to pump inlet 51. Some of the gas remaining in the well fluid upon entering chamber 63 flows up chamber 63, past motor 41 until it reaches pump seal 43, where the gas gathers. The gathering gas separates from the settling well fluid and enters vent 67. Vent 67 leads the gas out of chamber 63 through pump seal 43, to collection tube 73 which carries the gas into tubing 47, where the gas flows up the well to the surface. The liquid components of the well fluid in chamber 63 flow downward to pump inlet 51 and enter pump 39. Pump 39 increases the pressure of the well fluid and discharges the well fluid above pump seal 43, into the interior of conduit 15 above pump seal 43 to flow up the well.

To repair or maintain pump 39 and motor 41, hydraulic pressure to safety valve 31 is removed to close valve 31. Tubing 47 is pulled from conduit 15 without having to kill the well. If it is desired for other reasons to kill the well, the operator increases the well fluid pressure inside of conduit 15, which causes circulation valve 35 to actuate to its circulation position, allowing well fluid to flow from conduit 15 into annulus 21 and to the surface. Heavier liquid is circulated into conduit 15 and annulus 21 to kill the well.

Figure 2:
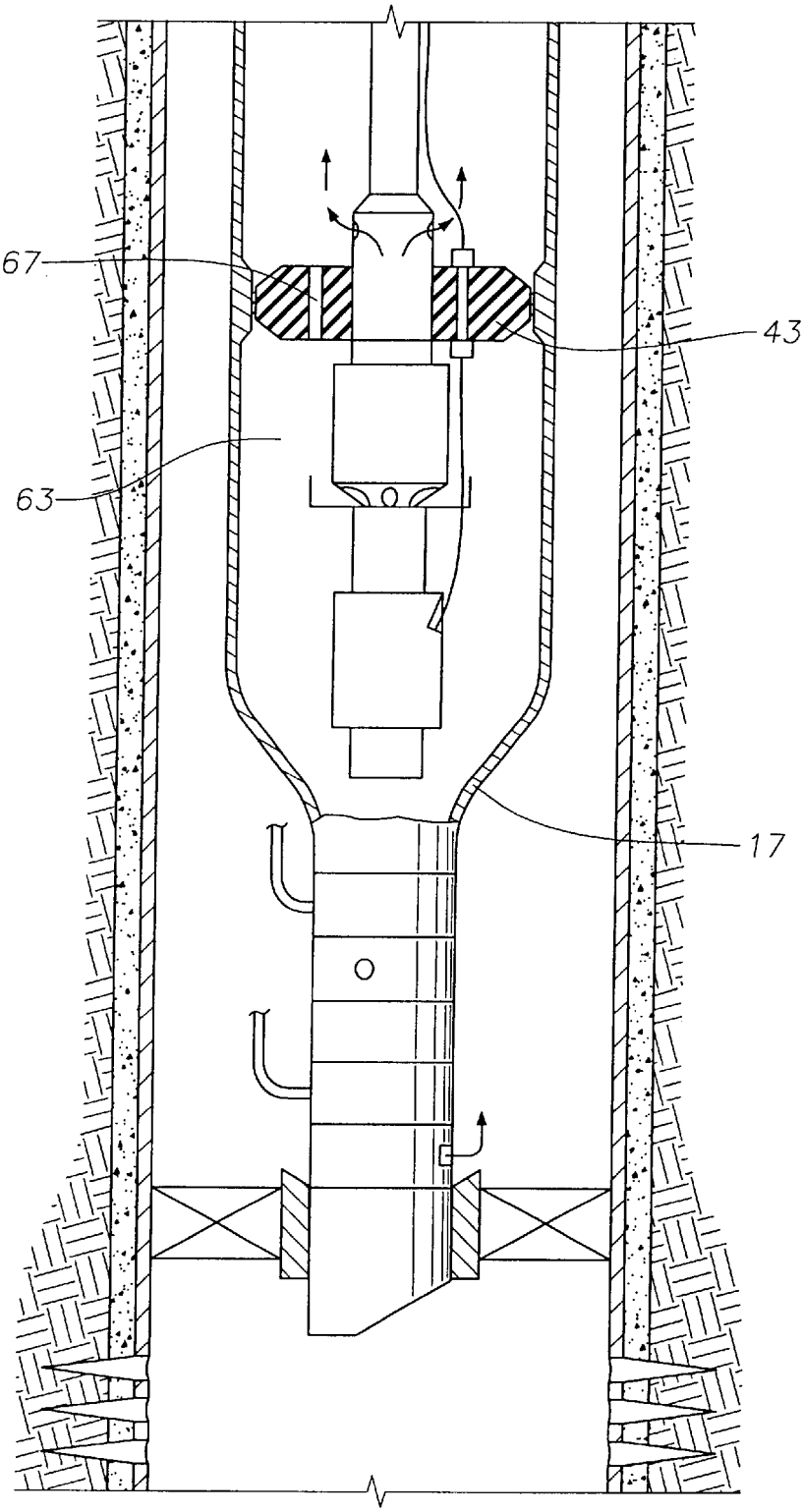
FIG. 2 comprises a schematic cross-sectional view of a second embodiment of a well constructed in accordance with this invention.

In the embodiment shown in FIG. 2, there is no collection tube 73 (in FIG. 1). In this embodiment, the gas remaining in the well fluid after separation gathers below pump seal 43 in the top of chamber 63. The gas separates from the settling well fluids and exits chamber 63 through vent 67. Vent 67 carries the gas through and above pump seal 43 to the interior conduit 15 where the gas continues flow up the well.

Figure 3:
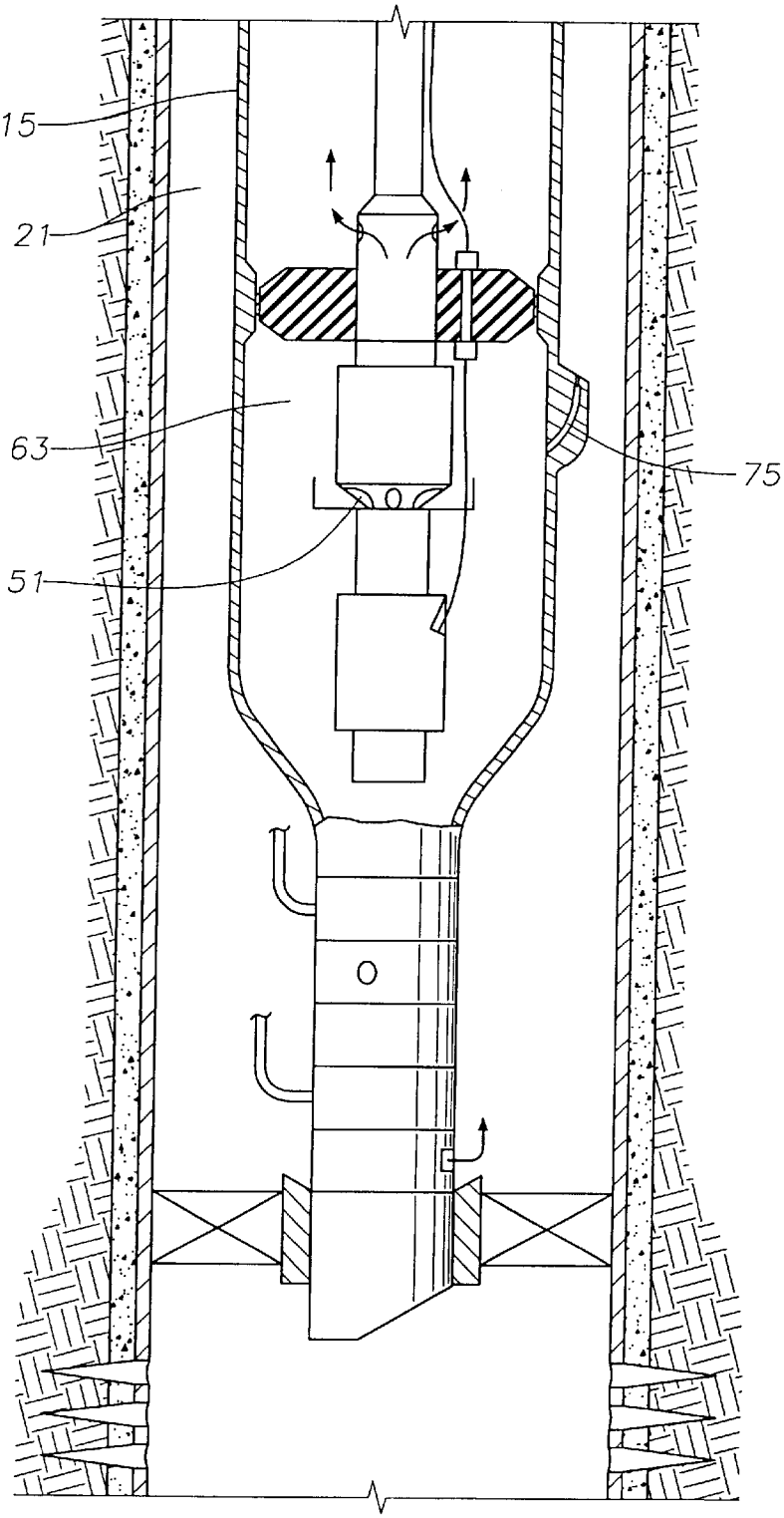
FIG. 3 comprises a schematic cross-sectional view of a third embodiment of a well constructed in accordance with this invention.

In another embodiment there is no vent 67 extending through pump seal 43. Rather, as shown in FIG. 3, a vent 75 is located above pump inlet 51 in a side pocket mandrel of conduit 15. Vent 75 has a first end located on the interior surface of conduit 15, and a second end located on the exterior surface of conduit 15, for venting gas into annulus 21. In operation, the gas collecting in chamber 63 above pump inlet 51 separates from the well fluid as the well fluid flows downward towards pump inlet 51. The separated gas gathers along the top of chamber 63 until there is enough gas collected to flow into vent 75. Vent 75 communicates the gas from chamber 63 to annulus 21, where the gas flows up the well under normal natural gas-lift properties. A check valve in vent 75 prevents downward flow of well fluid and gas from annulus 21.

Figure 4:
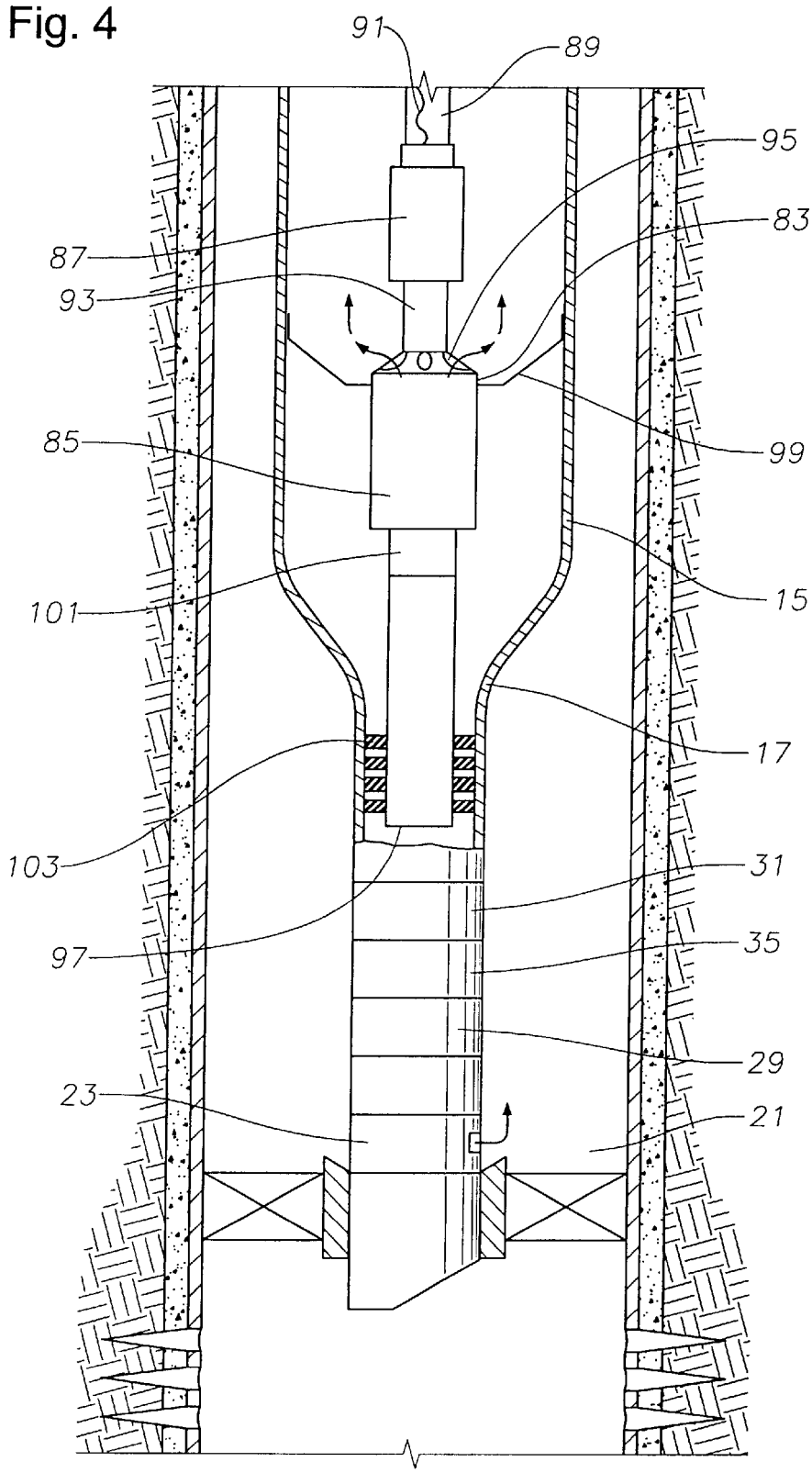
FIG. 4 comprises a cross-sectional view of a fourth embodiment of a well constructed in accordance with this invention.

A final embodiment, as shown in FIG. 4, shows a pump assembly 83 in which a pump 85 and a motor 87 are lowered on a string of coil tubing 89. Motor 87 is suspended above pump 85 from the lower end of coil tubing 89. A motor supply line 91, which supplies electrical current to motor 87, runs to motor 87 through the interior of coil tubing 89. Motor 87 drives pump 85 with a drive shaft (not shown) that is enclosed in a seal section 93 between motor 87 and pump 85. Pump 85 is an (ESP), normally a centrifugal type of pump, having at least one pump outlet 95 located on the upper section of pump 85, and at least one pump inlet 97 located on the lower section of pump 97. In the preferred final embodiment, a sand skirt 99 extends from the outer surface of pump 85, below pump outlet 95, to collect sand that flows down the well from above pump 85. Sand skirt 99 is a conical flexible member extending radially outward from pump 85 to conduit 15 below pump outlet 95. Sand skirt 99 collects sand that drops out of the flow stream. A flow meter 101 for measuring and monitoring the volumetric flow of well fluid may be located between pump inlet 97 and pump outlet 95.

A set of pump seals 103 are located around the outer surface of the lower section of pump 85, above pump inlet 97. Pump seals 103 seal pump 85 to reduced diameter portion 17 of conduit 15 above pump inlet 97. Pump assembly 83 is lowered by coil tubing 89 so that pump seals 103 seal pump 85 with the interior surface of conduit 15 when pump assembly is hung and landed.

In operation of the embodiment shown in FIG. 4, the chemically treated well fluid flows up conduit 15 through flow control valve 29, circulation valve 35, and downhole safety valve 31, towards pump 85. Pump seals 103, which seal pump 85 with reduced conduit inner diameter section 17, prevent the well fluid from flowing around pump 85 and force the well fluid to flow into pump inlet 97. Flow meter 101 measures the flow rate of the well fluid as while the well fluid travels through pump 85, and communicates the well fluid flow rate up the well. The well fluid exits pump 85 through pump outlet 95 and flows up the well alongside of coil tubing 89. Sand skirt 99 catches and collects any sand particles settling from the well fluid so that the sand does not damage the pump seals 103 below. Separated gas by separator 23 discharges into annulus 21 and flows to the surface.

With all of these embodiments, the gas separator removes most of the gas from the well, so the pump does not have to pump as much gas as without a separator. Having less gas flowing into the pump increases the efficiency of the pump, which means greater oil production. Furthermore, with all of these embodiments, the pump assembly may be removed for intervention without having to kill the well. Further, it will also be apparent to those skilled in the art that modifications, changes and substitutions may be made to the invention in the foregoing disclosure. Accordingly, it is appropriate that the appended claims be construed broadly and in he manner consisting with the spirit and scope of the invention herein.

What is claimed is:

1. A well, comprising:

a string of casing extending into a well;

a packer sealingly engaging the casing;

a conduit extending into the well, the conduit having a lower portion sealingly engaging the packer, the conduit having an opening in its lower portion for receiving well fluid from below the packer;

a gas separator mounted to the conduit for separating gas from the well fluid, the separator having a gas outlet above the packer;

a submersible pump assembly retrievable through the conduit independently of the gas separator, which comprises a pump and an electric motor, the pump assembly being lowered into the conduit and landing above the gas separator, the pump having an inlet and an outlet; and a pump seal located around the circumference of the pump between the pump inlet and the pump outlet, which seals the pump to the conduit.

2. The well of claim 1 wherein the lower portion of the conduit has a reduced diameter from the upper portion.

3. The well of claim 1 wherein:

the pump is located above the motor;

the pump seal defines a chamber located in the conduit below the pump seal and above the gas separator; and further providing that the chamber has a vent for bleeding off remaining gas collected in the chamber.

4. The well of claim 1 wherein:

the pump is located above the motor;

the pump seal defines a chamber located in the conduit below the pump seal and above the gas separator; and further providing that the chamber has a vent located in the conduit for bleeding off remaining gas collected in the chamber to an annulus surrounding the conduit.

5. The well of claim 1 wherein:

the pump is located below the motor;

and the gas separated from the well fluid by the gas separator is discharged directly into an annulus surrounding the conduit.

6. The well of claim 1 wherein the gas outlet of the gas separator further comprises an outlet port in direct communication with an annulus between the string of casing and the outer surface of the conduit.

7. The well of claim 1 wherein the gas separator is below and spaced away from the submersible pump assembly.

8. A well, comprising:

a string of casing extending into a well:

a packer sealingly engaging the casing;

a conduit extending into the well, the conduit having a lower portion sealingly engaging the packer, the conduit having an opening in its lower portion for receiving well fluid from below the packer;

a gas separator located in the conduit for separating gas from the well fluid, the separator having a gas outlet above the packer;

a submersible pump assembly, which comprises a pump and an electric motor, the pump assembly being lowered into the conduit and landing above the gas separator, the pump having an inlet and an outlet;

a pump seal located around the circumference of the pump between the pump inlet and the pump outlet, which seals the pump to the conduit; and a flow control valve located in the conduit below the pump assembly that allows the well fluid from below the packer to flow toward the pump, while preventing downward flow.

9. The well of claim 8, further comprising a circulation valve located in the conduit above the flow control valve, the circulation valve having a port that allows flow of a circulation fluid between the conduit and an annulus surrounding the conduit while in its circulation position, to enable circulation through the annulus.

10. A well, comprising:

a string of casing extending into a well;

a packer sealingly engaging the casing;

a conduit extending into the well, the conduit having a lower portion sealingly engaging the packer, the conduit having an opening in its lower portion for receiving well fluid from below the packer;

a gas separator located in the conduit for separating gas from the well fluid, the separator having a gas outlet above the packer;

a submersible pump assembly, which comprises a pump and an electric motor, the pump assembly being lowered into the conduit and landing above the gas separator, the pump having an inlet and an outlet;

a pump seal located around the circumference of the pump between the pump inlet and the pump outlet, which seals the pump to the conduit; and a safety valve which is selectively operated with hydraulic pressure and located in the conduit for preventing flow of well fluid toward the pump.

11. A well, comprising:

a string of casing extending into a well;

a packer sealingly engaging the casing;

a conduit extending into the well, the conduit having a lower portion sealingly engaging the packer, the conduit having an opening in its lower portion for receiving well fluid from below the packer;

a gas separator located in the conduit for separating gas from the well fluid, the separator having a gas outlet above the packer;

a submersible pump assembly, which comprises a pump and an electric motor, the pump assembly being lowered into the conduit and landing above the gas separator, the pump having an inlet and an outlet;

a pump seal located around the circumference of the pump between the pump inlet and the pump outlet, which seals the pump to the conduit;

and wherein the pump is located above the motor;

the pump seal defines a chamber located in the conduit below the pump seal and above the gas separator; and further providing that the chamber has a vent located in the pump seal for bleeding off remaining gas collected in the chamber, the vent fluidly connecting the chamber to the inside of the conduit above the pump seal.

12. A well, comprising:

a string of casing extending into a well;

a packer sealingly engaging the casing;

a conduit extending into the well, the conduit having a lower portion sealingly engaging the packer, the conduit having an opening in its lower portion for receiving well fluid from below the packer;

a gas separator located in the conduit for separating gas from the well fluid, the separator having a gas outlet above the packer;

a submersible pump assembly, which comprises a pump and an electric motor, the pump assembly being lowered into the conduit and landing above the gas separator, the pump having an inlet and an outlet;

a pump seal located around the circumference of the pump between the pump inlet and the pump outlet, which seals the pump to the conduit;

wherein:

the pump is located above the motor;

the pump seal defines a chamber located in the conduit below the pump seal and above the gas separator; and further providing that:

the pump is suspended in the conduit by a string of tubing; and the chamber has a vent located in the pump seal for bleeding off remaining gas collected in the chamber, so that the chamber is in fluid communication with the inside of the tubing.

13. A well, comprising:

a string of casing extending into a well;

a packer sealingly engaging the casing;

a conduit extending into the well, the conduit having a lower portion sealingly engaging the packer, the conduit having an opening in its lower portion for receiving well fluid from below the packer, an area surrounding the conduit and inside of the string of casing defining an annulus;

a gas separator located in the conduit for separating gas from the well fluid, the separator having a gas outlet above the packer;

a submersible pump assembly which comprises a pump and an electric motor, the pump assembly being lowered into the conduit and landing above the gas separator, the pump having an inlet and an outlet; and a flow control valve located in the conduit below the pump assembly that allows the well fluid from below the packer to flow toward the pump, while preventing downward flow; and a circulation valve located in the conduit above the flow control valve, the circulation valve having a part that allows flow of a circulation fluid between the conduit and the annulus while in its circulation position, to enable circulation through the annulus.

14. The well of claim 13, wherein the lower portion of the conduit has a lesser diameter than an upper portion, the gas separator being located in the lower portion and the pump assembly being located in the upper portion.

15. A well, comprising:

a string of casing extending into a well;

a packer sealingly engaging the casing;

a conduit extending into the well, the conduit having a lower portion sealingly engaging the packer, the conduit having an opening in its lower portion for receiving well fluid from below the packer, an area surrounding the conduit and inside of the string of casing defining an annulus;

a gas separator located in the conduit for separating gas from the well fluid, the separator having a gas outlet above the packer that leads to the annulus;

a pump having an inlet and an outlet, the pump being suspended by tubing and lowered into the conduit above the gas separator; and a pump seal located around the circumference of the pump between the pump inlet and outlet, which seals the pump to the conduit, the pump seal defining a chamber inside the conduit between the gas separator and the pump seal, the chamber having a vent that allows gas remaining in the well fluid after separation to exit the chamber.

16. The well of claim 15, wherein the vent allowing gas to exit the chamber comprises a passageway in the conduit with one end opening into the chamber, and another end opening into the annulus.

17. The well of claim 15, wherein the vent allowing gas to exit the chamber comprises a passageway running through the pump seal from a lower surface of the pump seal to an upper surface of the pump seal.

18. The well of claim 15, wherein the vent comprises a passageway through the pump seal and a collection tube leading from the passageway to the tubing.

19. The well of claim 15, wherein the lower portion of the conduit has a lesser diameter than an upper portion, the gas separator being located in the lower portion and the pump assembly being located in the upper portion.

20. The well of claim 15, further comprising;

a flow control valve located in the conduit that allows the well fluid from below the packer to flow toward the pump, while preventing downward flow;

a circulation valve located below the pump, the circulation valve having a port that allows flow of a circulation fluid between the conduit and the annulus while in its circulation position, to enable circulation through the annulus; and a safety valve which is selectively operated with hydraulic pressure and located below the pump for preventing flow of well fluid toward the pump.

21. A well, comprising:

a string of casing extending into a well;

a packer sealingly engaging the casing;

a conduit extending into the well, the conduit having a lower portion sealingly connected the packer, having an opening in its lower portion for receiving well fluid from below the packer, an area surrounding the conduit and inside of the string of casing defining an annulus, the lower portion of the conduit having a reduced diameter section;

a gas separator located in the reduced diameter section of the conduit for separating gas from the well fluid, the separator having a gas outlet above the packer;

a motor suspended in the conduit on a coil tubing that contains a power cable;

a pump having an inlet on a lower end and an outlet on an upper end, the pump being located below the motor, the lower end of the pump stabbing into the reduced diameter section; and a pump seal located around the circumference of the pump between the pump inlet and outlet, which seals the pump to the reduced diameter section.

22. The well of claim 21, wherein the gas separator located in the reduced diameter section of the conduit discharges gas into the annulus.

23. The well of claim 21, further comprising a sand skirt located on the outer surface of the pump below the pump outlets for collecting any sand particles settling from the fluid flowing up the conduit above the pump, the sand skirt extending radially away from the pump to the inner surface of the conduit.

24. A method for pumping well fluid from a well having a casing, a conduit extending into the casing and sealed to the casing by a packer, the method comprising:

(a) securing a gas separator to the conduit and then lowering the conduit into the casing; and then (b) lowering a pump assembly comprising a pump and a motor into the conduit to a point above the gas separator, and sealing the pump to the conduit;

(c) separating gas from the well fluid with the gas separator, (d) discharging the separated gas from the gas separator into an annulus surrounding the conduit; and (e) pumping the well fluid up the conduit.

25. The method for pumping well fluid of claim 24, wherein:

step (d) comprises porting the separated gas to the annulus at an axial position below the intake of the pump.

26. A method for pumping well fluid from a well having a casing, a conduit extending into the casing and sealed to the casing by a packer, the method comprising:

(a) mounting a gas separator in the conduit;

(b) lowering a pump assembly comprising a pump and a motor into the conduit to a point above the gas separator, and sealing the pump to the conduit;

(c) separating gas from the well fluid with the gas separator, (d) discharging the separated gas from the gas separator into an annulus surrounding the conduit;

(e) pumping the well fluid up the conduit; wherein:

step (b) comprises sealing the pump to the conduit with a pump seal, the pump seal defining a chamber below the pump seal and inside of the conduit above the gas separator; and the method further comprises:

(f) collecting any remaining gas in the chamber that was not separated from the well fluid by the gas separator; and (g) venting the remaining gas from the chamber.

27. The method for pumping well fluid of claim 26, wherein step (g) comprises venting the remaining gas from the chamber to the inside of the conduit above the pump seal.

28. The method for pumping well fluid of claim 26, wherein:

step (b) comprises lowering the pump assembly into the conduit with a string of tubing; and step (g) comprises venting the remaining gas from the chamber to the inside the string of tubing.

29. The method for pumping well fluid of claim 26, wherein step (g) comprises venting the remaining gas from the chamber to the annulus surrounding the conduit.

* * * * *

UNITED STATES PATENT AND TRADEMARK OFFICE

CERTIFICATE OF CORRECTION

PATENT NO. : 6,668,925 B2
DATED : December 30, 2003
INVENTOR(S) : Christopher K. Shaw et al.

It is certified that error appears in the above-identified patent and that said Letters Patent is hereby corrected as shown below:

Title page,
Item [56], References Cited, U.S. PATENT DOCUMENTS, insert
-- 6,322,331 11/2001 Swatek, et al.
6,352,113 3/2002 Neuroth -- after "6,216,788 4/2001 Wilson"
OTHER PUBLICATIONS, delete
"Inventor: Neuroth et al, Method and Apparatus to Remove Coiled Tubing Deployed Equipment in High Sand Applications.
Tubular Junction for Tubing Pump, This application claims the benefits of provisional application S.N. 60/107,919 filed Nov. 10, 1998."
Item [57], ABSTRACT
Line 1, delete the quotation marks before "Well"
Line 9, delete the quotation marks after "motor"

Column 4,
Line 45, delete "supply" and insert -- cable --

Column 6,
Line 14, insert -- to -- after "continues"
Line 39, delete "(ESP)" and insert -- ESP --

Column 10,
Line 57, insert -- to -- after "connected"

Signed and Sealed this

Twenty-seventh Day of April, 2004

JON W. DUDAS
*Acting Director of the United States Patent and Trademark Office*